US008657345B1

(12) United States Patent
Shih

(10) Patent No.: US 8,657,345 B1
(45) Date of Patent: Feb. 25, 2014

(54) SAFE LINKAGE LOCKSET

(76) Inventor: Feng-Ming Shih, Taichung (TW)

( * ) Notice: Subject to any disclaimer, the term of this patent is extended or adjusted under 35 U.S.C. 154(b) by 0 days.

(21) Appl. No.: 13/589,484

(22) Filed: Aug. 20, 2012

(51) Int. Cl.
*E05C 9/10* (2006.01)
*E05C 9/00* (2006.01)

(52) U.S. Cl.
USPC ..... 292/37; 292/32; 292/38; 292/42; 292/358

(58) Field of Classification Search
USPC ..... 292/32–34, 37, 38, 40, 42, 358, 359
See application file for complete search history.

(56) References Cited

U.S. PATENT DOCUMENTS

| | | | | | |
|---|---|---|---|---|---|
| 166,842 | A * | 8/1875 | Berryman | 292/7 |
| 958,880 | A * | 5/1910 | Lawson | 292/335 |
| 1,142,463 | A * | 6/1915 | Shepherd | 292/40 |
| 1,185,023 | A * | 5/1916 | Teich | 292/358 |
| 1,909,697 | A * | 5/1933 | MacBeth et al. | 292/36 |
| 1,959,809 | A * | 5/1934 | Benjamin | 221/154 |
| 1,970,758 | A * | 8/1934 | Lyons et al. | 292/358 |
| 2,481,429 | A * | 9/1949 | Kerr | 292/21 |
| 2,637,195 | A * | 5/1953 | Hurtel | 70/153 |
| 2,757,032 | A * | 7/1956 | Stieglitz | 292/34 |
| 2,920,474 | A * | 1/1960 | Johns | 70/451 |
| 3,333,878 | A * | 8/1967 | Pelcin | 292/37 |
| 3,953,061 | A * | 4/1976 | Hansen et al. | 292/5 |
| 4,099,753 | A * | 7/1978 | Gwozdz et al. | 292/177 |
| 4,288,944 | A * | 9/1981 | Donovan | 49/395 |
| 4,387,917 | A * | 6/1983 | Cocker | 292/40 |
| 4,584,984 | A * | 4/1986 | Croft | 126/25 R |
| 5,806,353 | A * | 9/1998 | Pages | 70/120 |
| 7,201,408 | B2 * | 4/2007 | Cennamo, Jr. | 292/143 |

* cited by examiner

*Primary Examiner* — Carlos Lugo
(74) *Attorney, Agent, or Firm* — Egbert Law Offices, PLLC

(57) ABSTRACT

A safe linkage lockset has a holding box, wherein a left and a right driving seat are assembled into its internal holding space parallelly and reversely. A linkage member is set rotatably between the driving seats. A door handle assembling portion is formed on the middle of the linkage member. The assembling portion could be provided with a door handle. When pressing the door handle, the linkage member will be driven so that the driving seats are driven close to each other. When pulling up the handle, the driving seats are driven far away from each other. Two bolt bars are separately located into the assembly hole of the driven end on left and right driving seats, and the action end of bolt bar is protruded out of the holding box. Hence, this could adapt to common users locking and unlocking habit.

5 Claims, 7 Drawing Sheets

SAFE LINKAGE LOCKSET

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a lockset, and more particularly to an innovative one which is designed with a safe linkage structure allowing for unlocking by pressing.

2. Description of Related Art Including Information Disclosed Under 37 CFR 1.97 and 37 CFR 1.98

Locksets of various types and models are widely used on various occasions. A lockset is generally arranged on left and right doors, permitting to unlock both doors in the event of emergency, or unlock a single door at ordinary times. Generally, a lockset is separately set onto a door's upper and lower ends to fix the door. However, the users have to climb up via a ladder to the upper end of the door for releasing the bolt, and then go down to the lower end of the door for unlocking. So, there occur some problems such as: security hazards of falling down, relatively slow unlocking speed and untimely escape in emergency situations. Hence, an outdoor linkage lockset has been developed to address aforementioned problems. Wherein, a push handle is set on the middle of the door. A locking structure located on upper and lower ends could be driven by pushing horizontally the push handle. However, this kind of linkage lockset lacks of locking functions, so it could only be applied to an exit door rather than the doors of warehouses, factories or households, etc. Moreover, this outdoor mounting design is also unsuitable for above-specified patterns, so there are still some disadvantages with lower applicability. Hence, such outdoor linkage lockset has gradually been replaced by a handle pressing linkage lockset, which is researched and improved in the present invention for its linkage structure.

A conventional lockset with handle pressing linkage structure comprises a linkage structure connected to the door handle, an upper and a lower sliding seat driven by the linkage structure and a bolt bar located on the end of each sliding seat. When the door handle is pressed by the user, the upper and lower sliding seats could be driven by the linkage structure far away into a protruding state, so the bolt bar is separately fixed on the doorframe and ground for locking purpose. On the contrary, when user pulls up the door handle, the upper and lower sliding seats are mated to each other for unlocking purpose.

However, in the event of fire alarms or other emergency situations, most people are eager for unlocking from the exit door by directly pressing the door handle (a habit for using a press handle). Yet, at this moment, the action of pressing the door handle will lock the door, causing the loss of optimum opportunity for escape and subsequent security hazards. Therefore, the design of the conventional lockset cannot meet the common users' needs since it is contrary to their operating habit.

Moreover, as mentioned above, one of the exit doors is generally locked under normal circumstances. However, referring to the left diagram in FIG. 1, when the conventional lockset is in a locked state, the door handle A is in a pressing state. So, this will not only cause misunderstanding that the door can be directly opened by pushing, but also the handle in a normal pressing state looks inconsistent, making both doors aesthetically unpleasing.

Besides, referring to FIG. 1, even though two doors are in an unlocked state, people will have an illusion to open the door by pressing door handle A, since the door handle A is in a flat state. This will significantly reduce the ease of operation and utilization. So sum up, the conventional linkage structure of a lockset is still difficult to meet the users' operating habit, resulting in potential security risk and inconvenience in operation.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the structural design of the "safe linkage lockset" of the present invention wherein the linkage member could be driven, so that the left and right driving seats are driven relatively close to each other when pressing the door handle; or driven far away from each other when pulling up the door handle; this could overcome the problem of operational inconvenience and security risk in emergency when the conventional lockset is in a locking state if pressing the door handle. Based on the unique design, the present invention could adapt to common users' locking and unlocking habit. When pressing the door handle to drive the linkage member, the left and right driving seats are driven relatively close to each other in an unlocking state. Hence, this operating mode could adapt to common users, significantly improve the operating convenience in emergency and reduce unlocking time while enhancing the operational security.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
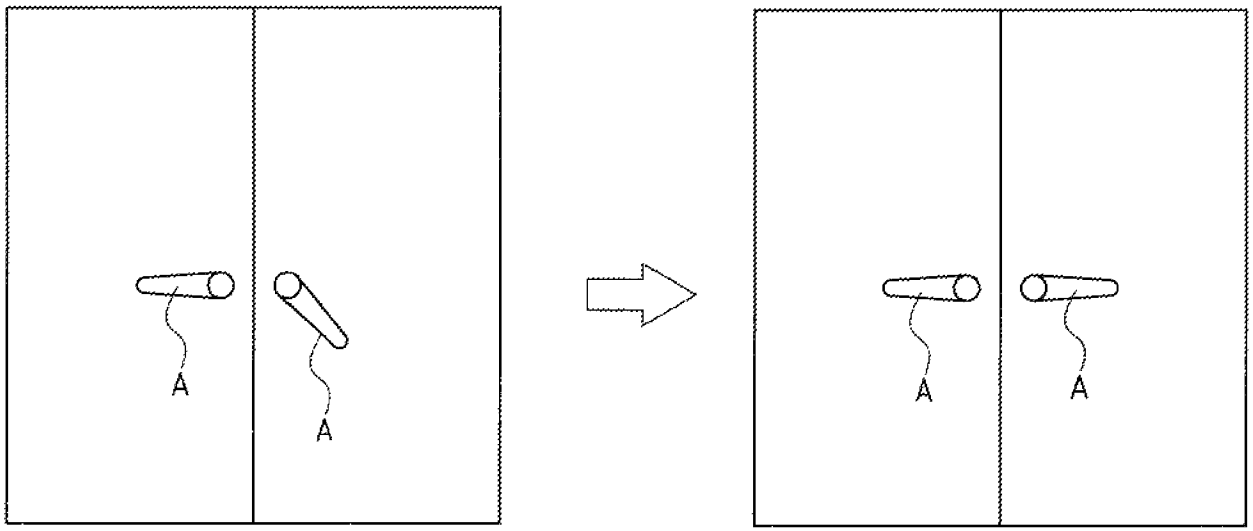
FIG.1 PRIOR ART
FIG. 1 is a status view of locking and unlocking of conventional lockset.
Figure 2:
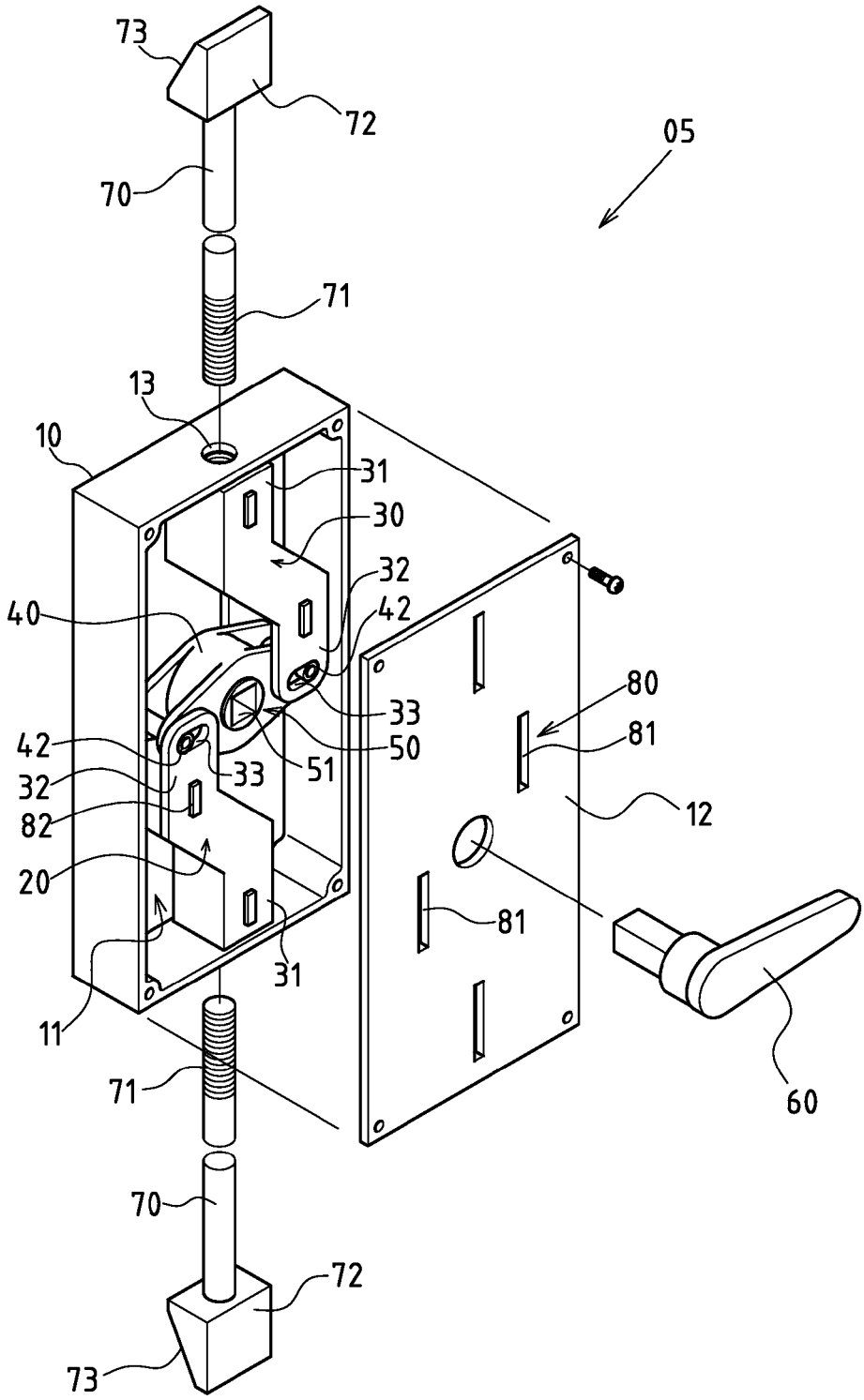
FIG. 2 is an exploded perspective view of the present invention.
Figure 3:
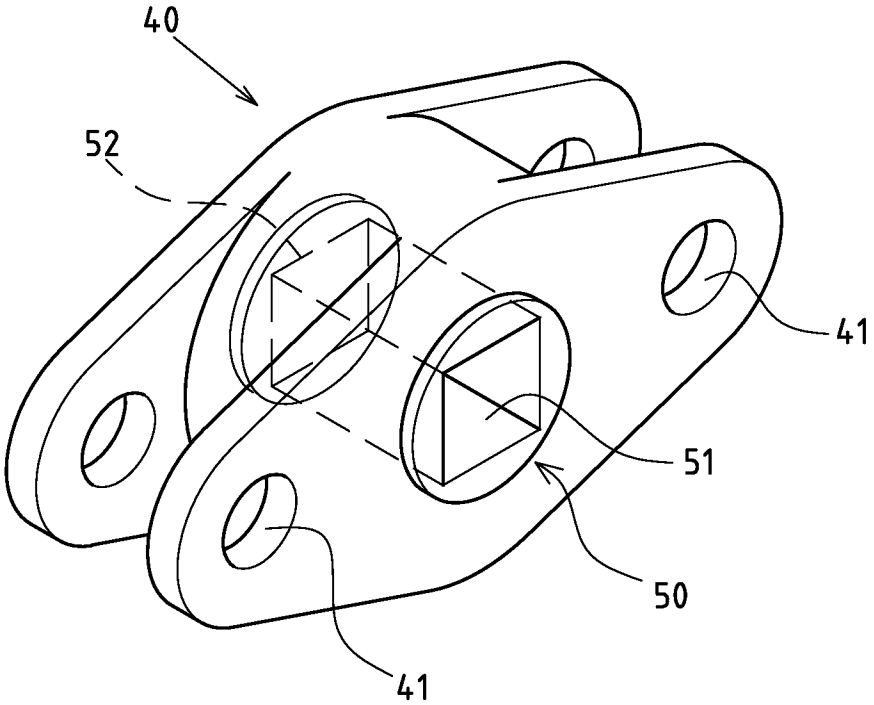
FIG. 3 is a perspective view of the linkage member structure of the present invention.
Figure 4:
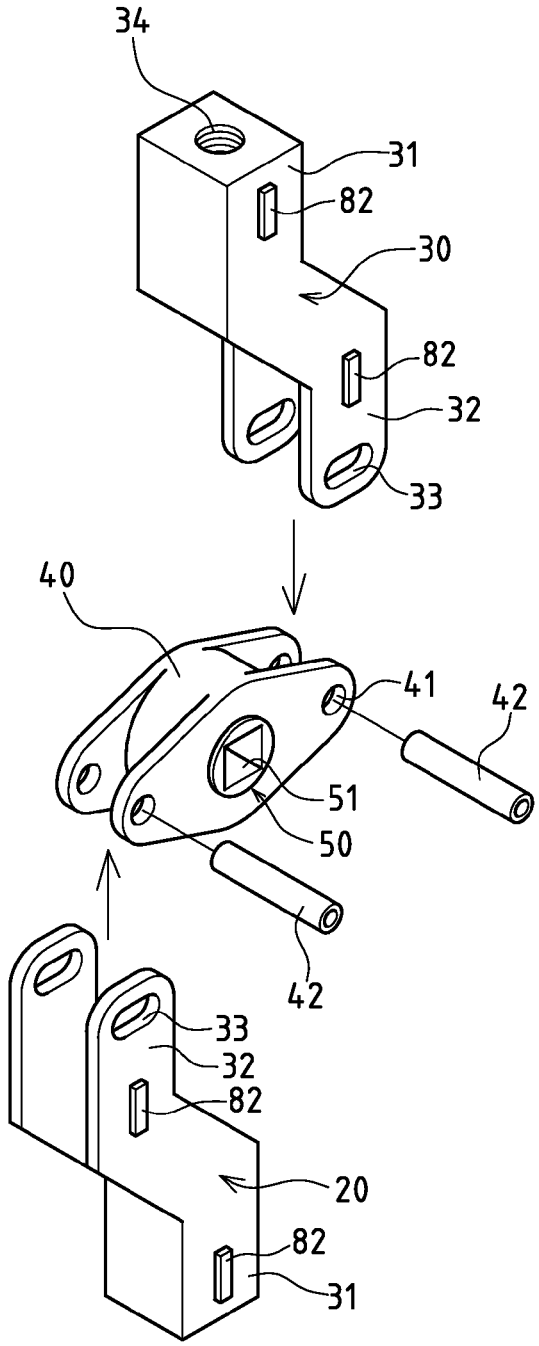
FIG. 4 is an exploded perspective view of the linkage member and left/right driving seats of the present invention.

FIGS. 2-4 depict preferred embodiments of an improved safe linkage lockset of the present invention, which, however, are provided for only explanatory objective for patent claims. Said lockset 05 comprises a holding box 10, comprising of an internal holding space 11, a circumferential wall 12, and a through member 13 which penetrates the upper and lower ends of the holding box 10.

A left driving seat 20 and a right driving seat 30 are assembled into the internal holding space 11 in a vertical displacement pattern. The left and right driving seats 20, 30 are parallelly and reversely arranged at interval, and also provided with a driven end 31 and a driving end 32. Of which, as horizontally extended slotted hole 33 is set on the driving end 32, and an assembly hole 34 is set vertically on the driven end 31.

A linkage member 40 is rotatably set between the left and right driving seats 20, 30. Both ends of the linkage member 40 are provided with through holes 41 correspondingly to the slotted holes 33 of the left and right driving seats 20, 30. A positioning member 42 penetrates the slotted hole 33 and through hole 41, enabling the left and right driving seats 20, 30 to be connected with the linkage member 40. When the linkage member 40 is rotated, the left and right driving seats 20, 30 are driven relatively close to or far away from each other.

A door handle assembling portion 50 is formed on the middle of the linkage member 40 to define a first open end 51 and a second open end 52 (only shown in FIG. 3). The linkage member 40 could be rotated by taking the door handle assembling portion 50 as a pivot.

At least a door handle 60 is located at least on the first open end 51 or the second open end 52 of the door handle assembling portion 50. When pressing the door handle 60, the linkage member 40 could be driven so that the left and right driving seats 20, 30 are abutted to each other. When pulling up the door handle 60, the left and right driving seats 20, 30 are driven far away from each other. Two bolt bars 70 are provided with a connecting end 71 and an action end 72. The connecting end 71 of two bolt bars 70 is separately locked into the assembly hole 34 of the driven end 31 located on the left and right driving seats 20, 30, while the action end 72 is protruded out of through member 13 of the holding box 10.

Based on above-specified structural design for meeting the common users' operating habit (namely, firstly pressing the handle when opening doors or unlocking), when the door handle 60 is pressed to drive the linkage member 40 for rotation, the left and right driving seats 20, 30 are driven relatively close to each other for an unlocking state, thus significantly improving the operating convenience in emergency state.

Based on above-specified structural design, the present invention is operated as follows:

Referring to FIGS. 2 and 4, an auxiliary guide portion 80 is set on the holding box 10 correspondingly to the left and right driving seats 20, 30. It comprises of a spacing groove 81 on the circumferential wall 12 of the holding box 10 and a guide block 82 on the corresponding locations of the left and right driving seats 20, 30, so as to guide the displacement state of the left and right driving seats 20, 30.

Figure 5:
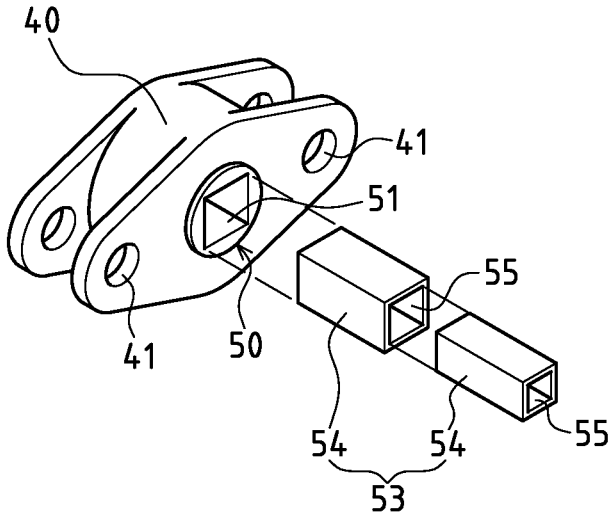
FIG. 5 is an exploded perspective view of the linkage member and the adaptor of the present invention.

Referring to FIGS. 3 and 5, the first and second open ends 51, 52 on the door handle assembling portion 50 are provided with an adaptor 53 for insertion of door handle 60 (for example, it is set on the first open end 51 in the present embodiment). The adaptor 53 is formed by a plurality of dimensional blocks 54 by insertion and overlapping. The adaptor 53 is fitted with inserting holes 55 of various diameters to meet the door handles 60 of various dimensions.

Figure 6:
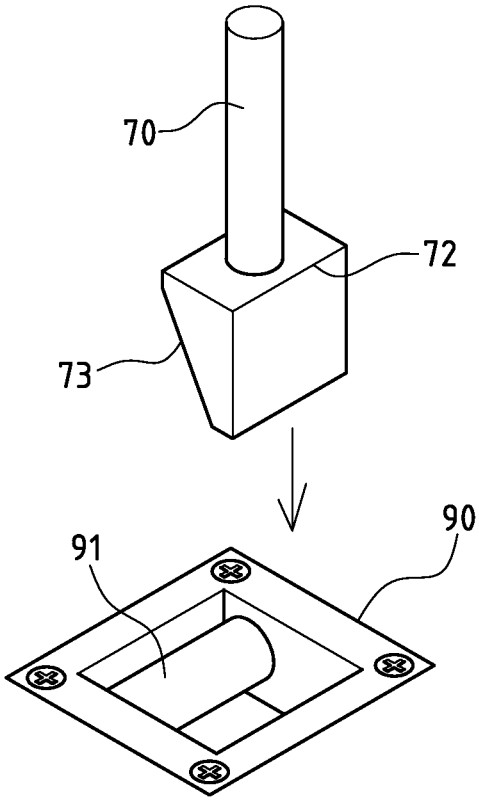
FIG. 6 is an actuating status view of the present invention wherein the bolt bar is inserted into a positioning seat.

Referring to FIG. 6, the action end 72 of the bolt bar 70 is inserted into a positioning seat 90, and provided with an oblique guide surface 73. An idler wheel 91 is located on the positioning seat 90. When the action end 72 is inserted into the positioning seat 90, said oblique guide surface 73 is mated with the idler wheel 91, realizing a tightening effect and avoiding the loosening of doors.

Figure 7:
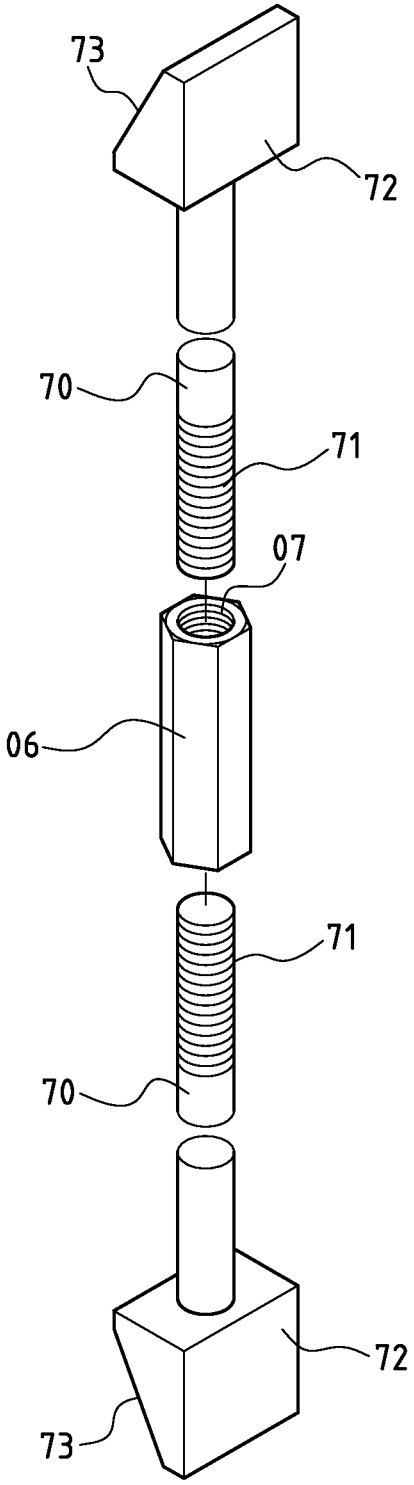
FIG. 7 is a mating status view of the bolt bar and the extensible joint of the present invention.

Referring to FIG. 7, the lockset linkage structure 05 allows the bolt bar 70 to be extended via an extensible joint 06. The extensible joint 06 is fitted with two reversed screw holes 07 for screwing of the bolt bar 70, helping to meet the height requirements of the doors.

Figure 8:
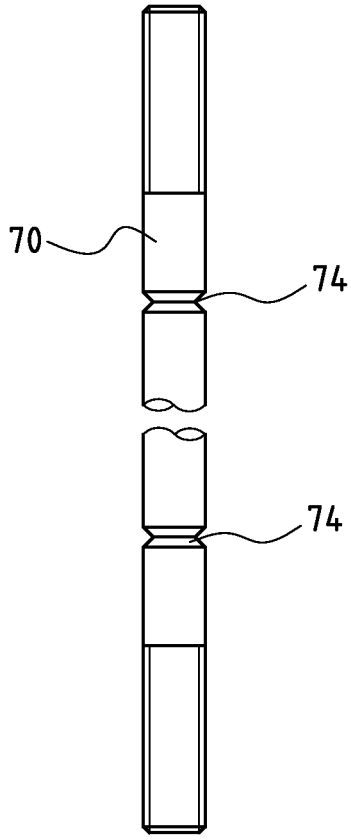
FIG. 8 is an application view of the present invention wherein the bolt bar is provided with a cutting identification edge.

Referring to FIG. 8, a cutting identification edge 74 is formed on the bolt bar 70 for providing an obvious and accurate auxiliary identification point when the bolt bar 70 is cut. The length of bolt bar 70 could be cut according to the users' operating requirements.

Figure 9:
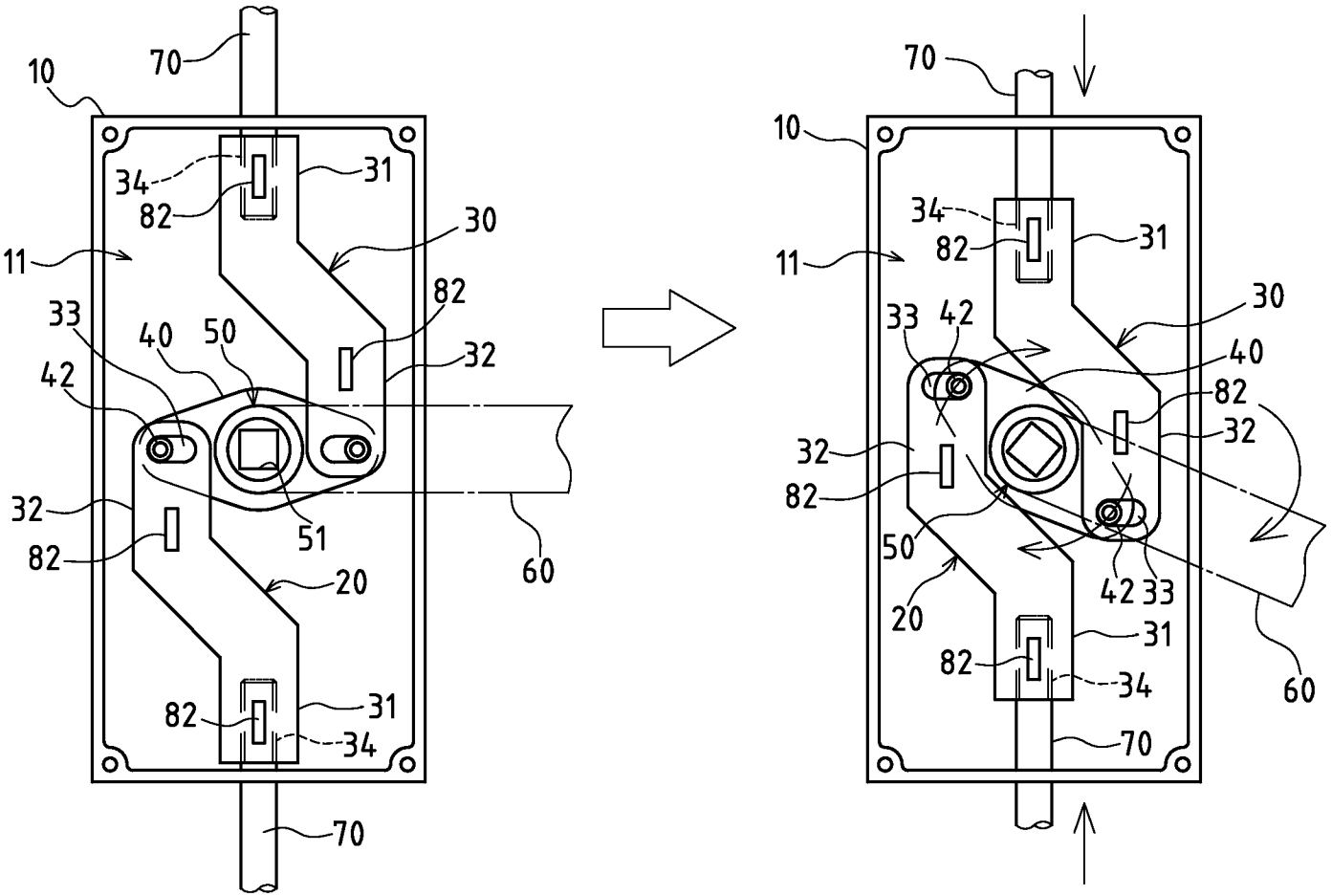
FIG. 9 is an actuating status view of the present invention.

Based on above-specified structural design, the present invention is operated as follows:

Referring to FIGS. 2 and 9, when a user presses the door handle 60, the linkage member 40 could be driven so that the left and right driving seats 20, 30 are abutted to each other. Two bolt bars 70 are also linked for inward displacement and unlocking operation to meet the common users' operating habit (pressing the handle when opening doors or unlocking). In the event of an emergency, unlocking action could be finished promptly in tune with the users' operating habit, thus gaining more time for escape and significantly enhancing the security. While pulling up the door handle 60, the linkage member 40 could be driven so that left and right driving seats 20, 30 are far away from each other in a locking state (not shown graphically). Hence, such structural design enables substantial improvement of the ease of operation.

I claim:

1. A locket apparatus comprising:

a holding box having an internal holding space and a circumferential wall and a through member, said through member penetrating an upper end and a lower end of said holding box;

a left driving seat and a right driving seat assembled into said internal holding space so as to be vertically displaceable, said left driving seat and said right driving seat arranged in spaced parallel relationship, each of said left and right driving seats having a driven end and a driving end, said driving end having a horizontally extended slotted hole, said driving end having an assembly hole set vertically therein;

a linkage member rotatably positioned between said left and right driving seats, said linkage member having ends provided with through holes corresponding to the slotted holes of said left and right driving seats;

a positioning member extending through the through hole and the slotted hole so as to enable said left and right driving seats to be connected to said linkage member, a rotation of said linkage member causing said left and right driving seats to move toward or away from each other;

a door handle assembling portion formed at a middle of said linkage member so as to define a first open end and a second open end, said linkage member rotated by said door handle assembling portion;

at least one door handle located on at least one of said first open end said second open end of said door handle assembling portion, said linkage member being driven by pressing the door handle such that said left and right driving seats abut each other, said linkage member being driven by pulling the door handle such that said left and right driving seats are driven away from each other;

a pair of bolt bars each having a connecting end and an action end, the connecting ends of said pair of bolt bars separately locked into said assembly hole of the driven ends of said left and right driving seats, the action end protruding outwardly of said through member of said holding box; and an auxiliary guide portion set on said holding box and corresponding to said left and right driving seats, said auxiliary guide portion having a spacing groove and a guide block so as to guide a displacement of said left and right driving seats.

2. The lockset apparatus of claim 1, said first and second open ends of said door handle assembly portion having an adaptor for insertion of the door handle, said adaptor formed by a plurality of dimensional blocks, said adaptor fitted with inserting holes of various diameters.

3. The lockset apparatus of claim 1, said linkage member allowing a bolt bar to be extended by an extensible joint, said extensible joint fitted with a pair of screw holes, said bolt bar screwed into said screw holes.

4. The lockset apparatus of claim 3, said bolt bar having an action end inserted into a positioning seat and provided with an oblique guide surface, said positioning seat having an idler wheel positioned thereon, said oblique guide surface being mated with said idler wheel when said action end is inserted into said positioning seat.

5. The lockset apparatus of claim 3, said bolt bar having a cutting identification edge formed thereon.

* * * * *